US006595376B1

(12) United States Patent
Lin

(10) Patent No.: US 6,595,376 B1
(45) Date of Patent: Jul. 22, 2003

(54) CLAMP DEVICE FOR HOLDING TOOL WITH SHANK

(76) Inventor: Joseph Jui-Chin Lin, No. 89, Shin Yuan St, Da Yuan, Tao Yuan (TW)

( * ) Notice: Subject to any disclaimer, the term of this patent is extended or adjusted under 35 U.S.C. 154(b) by 0 days.

(21) Appl. No.: 10/092,627

(22) Filed: Mar. 8, 2002

(51) Int. Cl.[7] ..... H47F 5/00

(52) U.S. Cl. ..... 211/70.6; 211/66; 211/89.01; 248/316.2; 248/316.3

(58) Field of Search ..... 211/65, 66, 89.01, 211/70.6; 248/316.2, 316.3

(56) References Cited

U.S. PATENT DOCUMENTS 1,485,092 A * 2/1924 Rauchut
1,494,252 A * 5/1924 Kane
3,013,756 A * 12/1961 Boston
3,294,350 A * 12/1966 Grottola
3,422,960 A * 1/1969 Ell et al.
3,580,394 A * 5/1971 Elliot
3,672,619 A * 6/1972 Bowen
5,165,629 A * 11/1992 Breveglieri ..... 211/89.01 X
5,342,010 A * 8/1994 Huang ..... 248/316.3

* cited by examiner

*Primary Examiner*—Robert W. Gibson, Jr.
(74) *Attorney, Agent, or Firm*—Rosenberg, Klein & Lee

(57) ABSTRACT

A clamp device which includes a base has a recess defined between two protrusions, and a chamber is defined in an inside of one of the two protrusions. A friction pad is attached to an inside of the other of the two protrusions. A frame with an inclined plate is received in the chamber and two parallel rails extend from a top surface of the inclined plate. A roller is received in the chamber and two grooves are defined in an outer surface of the roller. A friction member is mounted to the roller and located between the two grooves so that the rails are movably engaged with the grooves. A shank of a tool can be held by the friction member and the friction pad.

5 Claims, 8 Drawing Sheets

CLAMP DEVICE FOR HOLDING TOOL WITH SHANK

FIELD OF THE INVENTION

The present invention relates to a tool holding rack and includes an inclined plate and a friction member movably connected to the inclined plate. A shank of a tool is clamped between the friction member and a friction pad on an opposite side of the friction member.

BACKGROUND OF THE INVENTION

A conventional tool clamp device for holding the shank of a tool is disclosed in U.S. Pat. No. 5,342,0101 to Huang and FIGS. 7 and 8. The tool holding base 60 includes four protrusions 63 so as to define four recesses 632 therebetween. Each protrusion 63 has a friction pad 633 attached to an inside thereof and the opposite sides of the frictions 63 between the two outmost protrusions 63 each have a chamber 631. A frame 61 including an inclined plate is inserted in each of the chambers 631 and a rail extends from each of the inclined plates. A rack 611 is defined on each of the rails. A roller 62 is engaged with each of the frame 61 and includes a groove with teeth 621 defined in a surface defining the groove so that the teeth 621 are engaged with the rack 611. Two friction rings 622 are mounted to each of the rollers 62. A shank of a took is held between the friction rings 622 and the friction pad 633. The manufacturing cost is so high because the teeth 621 and the rack 611 require precise molds which are expensive. Besides, as shown in FIG. 8, A guide board 71 attached on the package of the clamp device is asked to be used on a wall 50 and pre-set marks 711 are printed on the guide board 71 so that the base 60 is nailed on the wall 50 by putting nails through the base 60 and the marks 711.

The guide board 71 is made of paper and easily torn apart or deformed so that the installation could not be as expected.

SUMMARY OF THE INVENTION

In accordance with one aspect of the present invention, there is provided a clamp device which comprises a base having at least two protrusions and a recess is defined between the two protrusions. A chamber is defined in an inside of one of the at least two protrusions and a friction pad is attached to an inside of the other of the at least two protrusions.

A frame is received in the chamber and has an inclined plate with two parallel rails extending from a top surface of the inclined plate. A roller is received in the chamber and two grooves are defined in an outer surface of the roller. A friction member is mounted to the roller and located between the two grooves. The roller is movably connected to the inclined plate by engaging the two rails with the grooves of the roller.

The primary object of the present invention is to provide a tool clamp device that is made at a lower cost and can hold the shanks of tools of different sizes.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
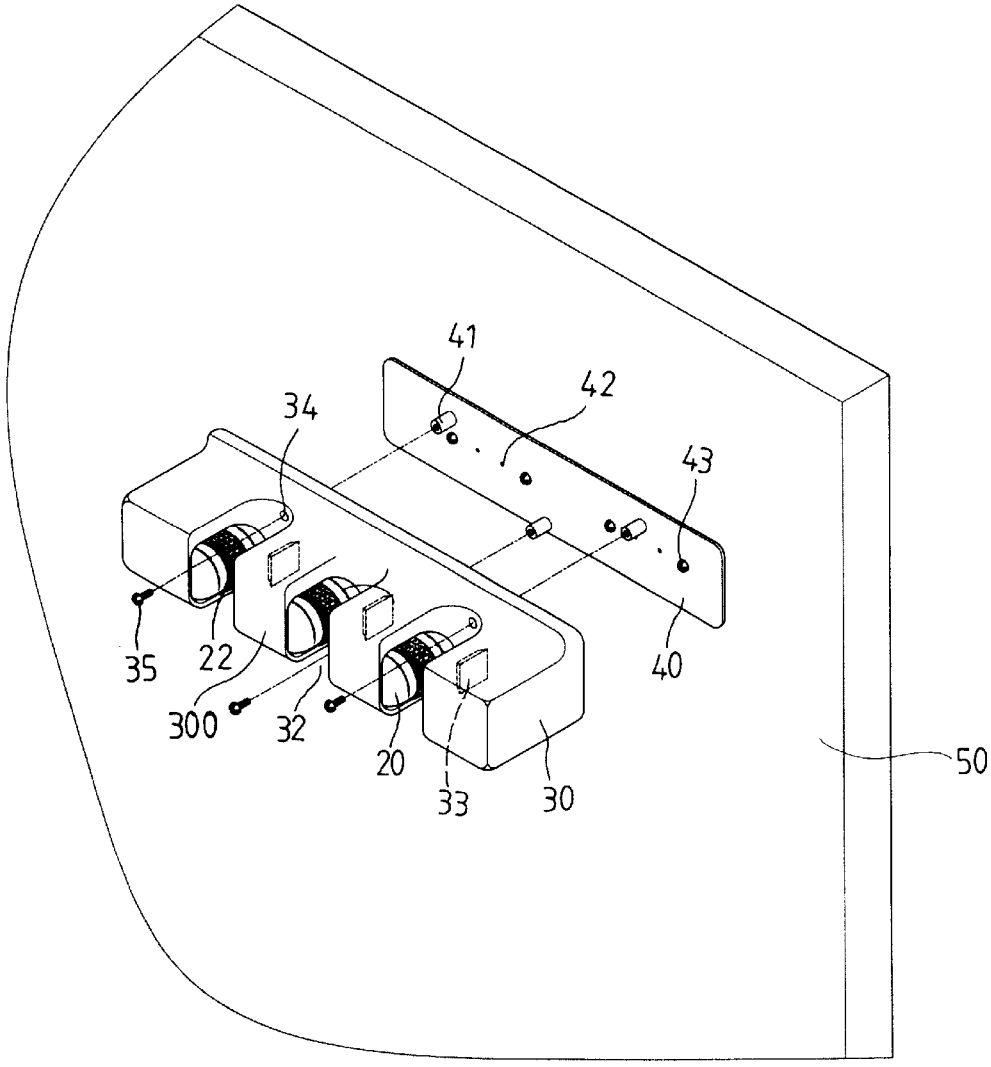
FIG. 1 is an exploded view to show the clamp device of the present invention and a board on a wall.
Figure 2:
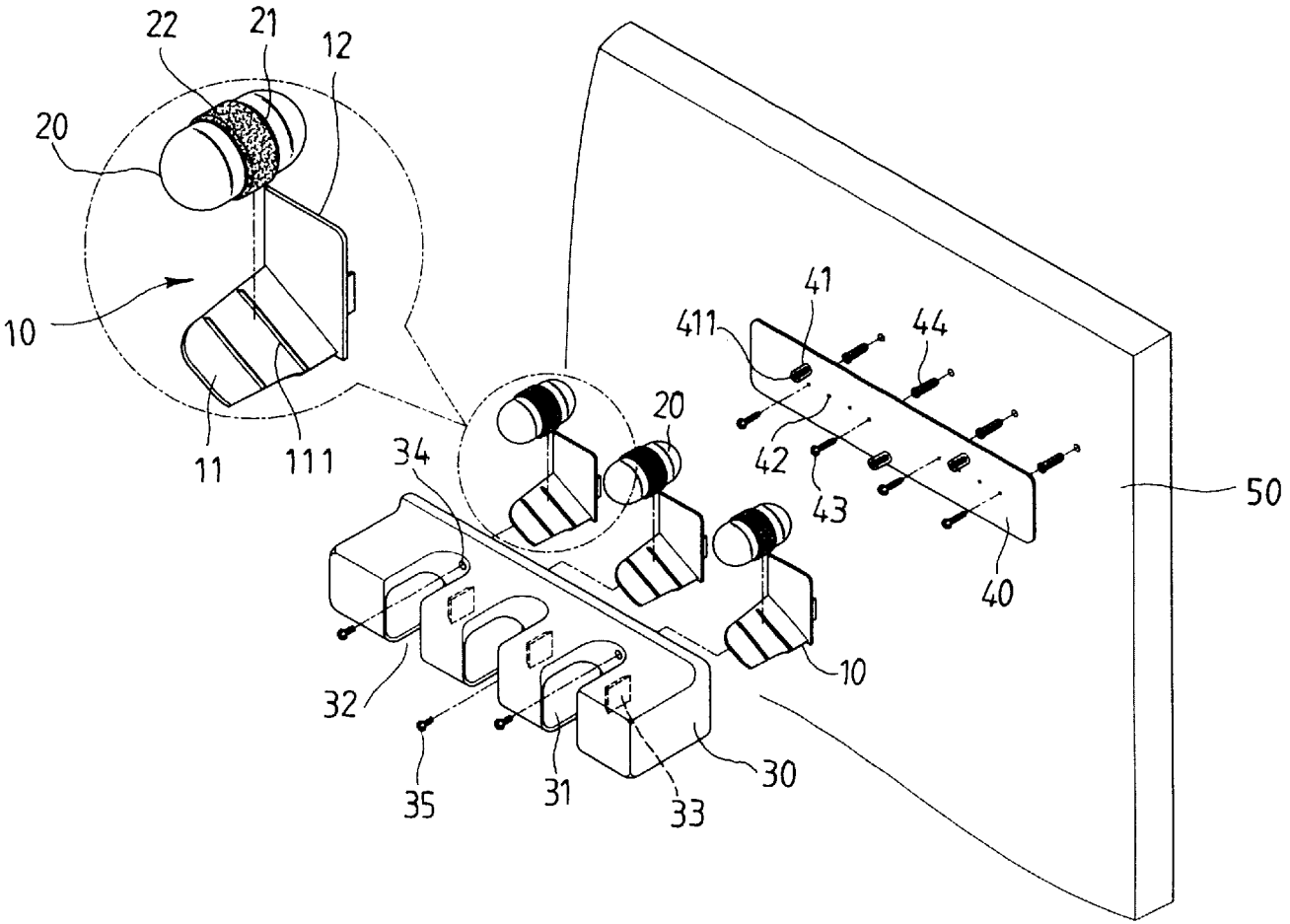
FIG. 2 is an exploded view to show the rollers, the frames and the base of the clamp device of the present invention.
Figure 3:
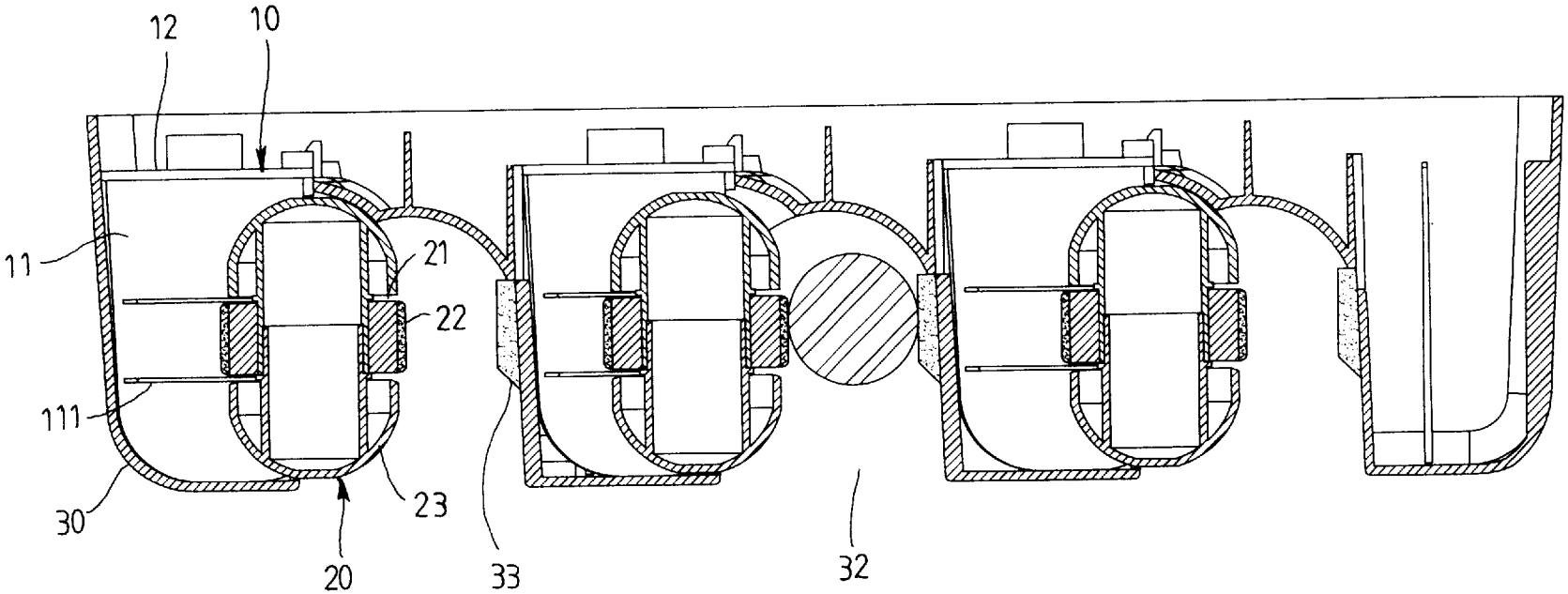
FIG. 3 is a cross sectional view to show the clamp device of the present invention.

Referring to FIGS. 1 to 3, the clamp device of the present invention comprises a base 30 having four protrusions 300 and a recess 32 defined between any two adjacent protrusions 300. A chamber 31 is defined in an inside of the three consecutive protrusions 300 and a friction pad 33 is attached to an inside of respective one of the protrusions 300 next to the chamber 300.

A frame 10 is received in each of the chambers 31 and has an inclined plate 11 and a vertical plate 12 which extends from a side of the inclined plate 11. Two parallel rails 111 extend from a top surface of the inclined plate 11. A roller 20 is received in each of the chambers 31 and two grooves 21 are defined in an outer surface of the roller 20. A friction member 22 is mounted to the roller 20 and located between the two grooves 21. The roller 20 is movably connected to the inclined plate 11 by engaging the two rails 111 with the grooves 21 of the roller 20.

Figure 4:
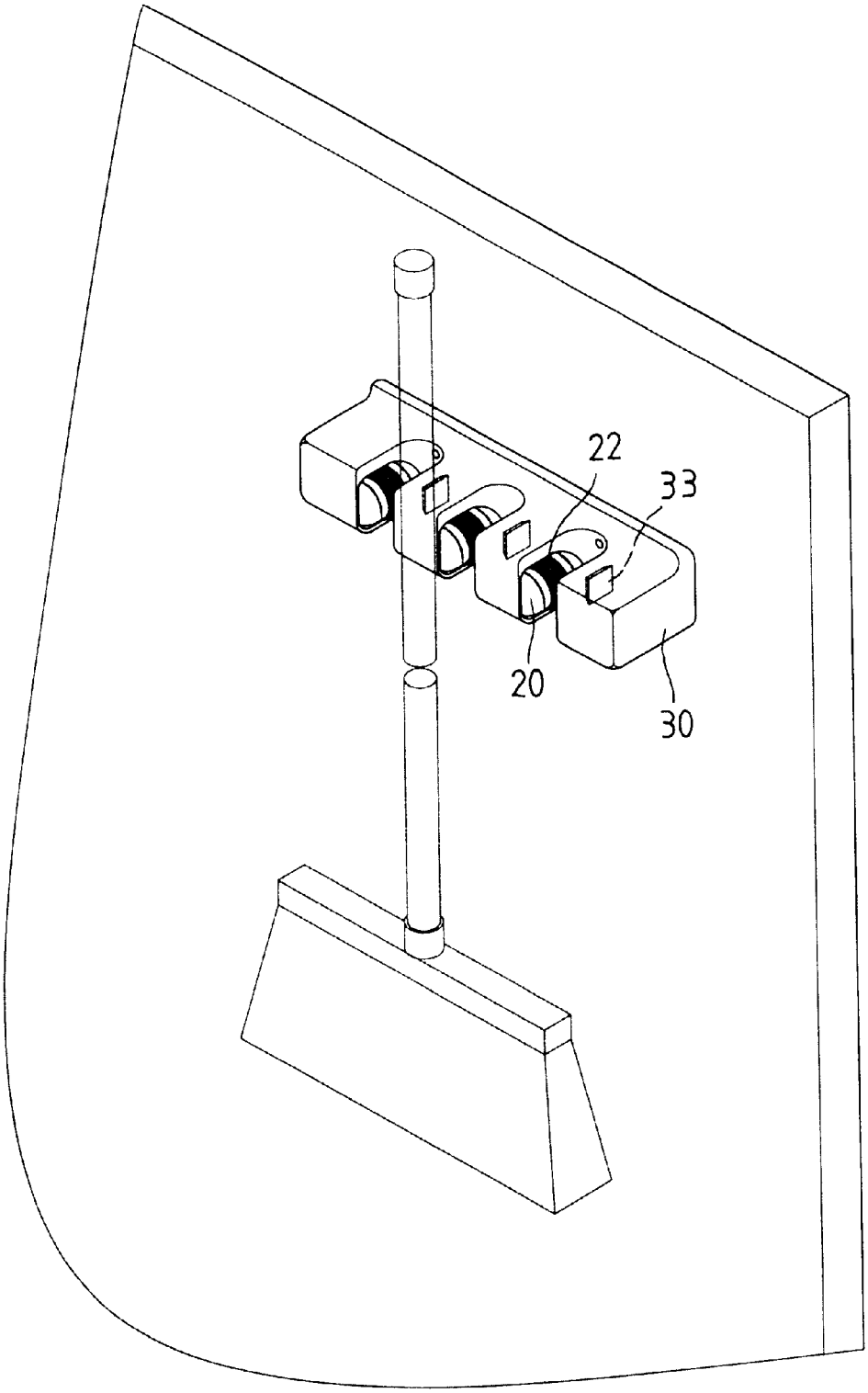
FIG. 4 is a perspective view to show a shank of a tool is held by the clamp device of the present invention.

As shown in FIG. 4, when a shank of a tool is inserted in the recess 32, the roller 20 rolls downward on the rails 111 till the friction member 22 contacts the shank which is then held by the friction member 22 and the friction pad 33.

A board 40 is connected on a wall 50 and includes two tubes 41 extending from the board 40. Each of the tubes 41 has a plastic socket 44 received therein. A threaded hole 411 is defined in the tube 41 and two apertures 34 are defined through the base 30 and located between two protrusions 300. A screw 35 extends through one of the apertures 34 and threadedly engaged with the plastic socket 44 in the threaded hole 411 of the tube 41 located in alignment with the aperture 34 to connect the base 30 to the wall 50. Several marks 42 are printed on the board 40 and nails 43 are used to fix the board 40 on the wall 50.

Figure 5:
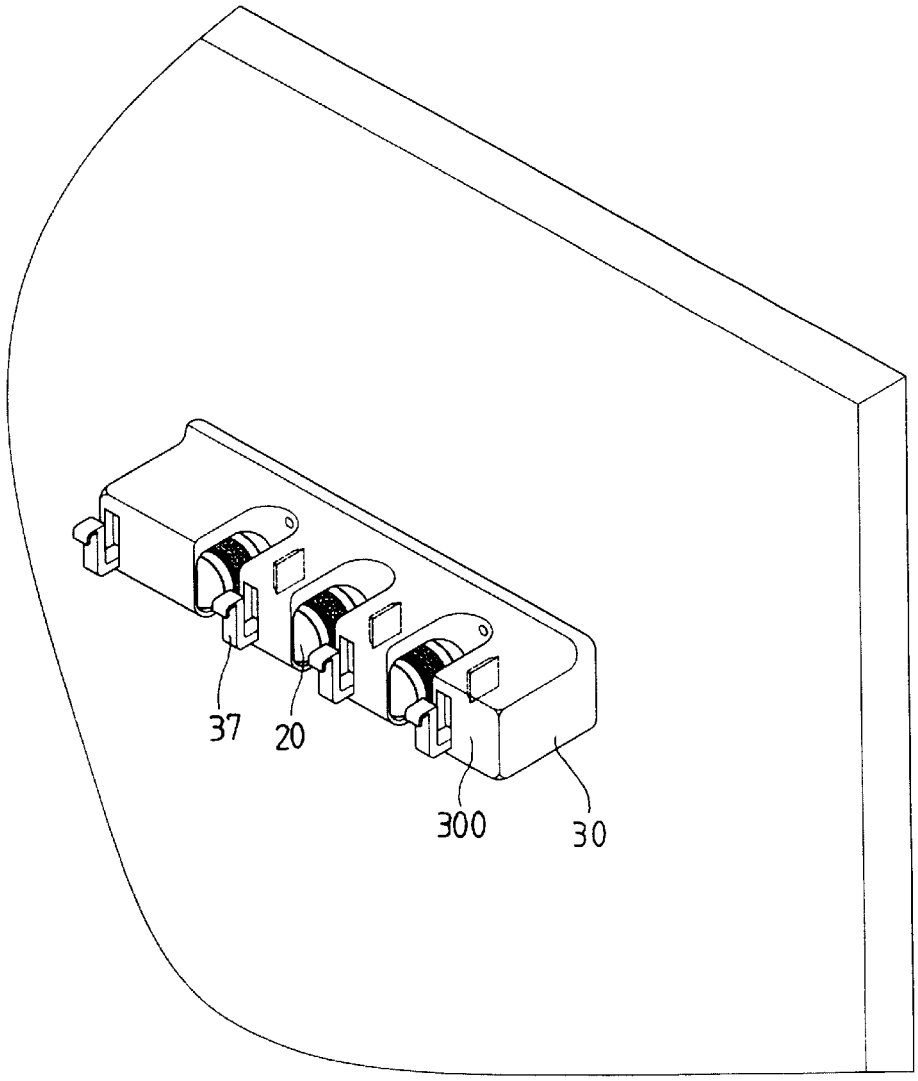
FIG. 5 is a perspective view to show the clamp device of the present invention wherein a hook is connected to the base of the device.
Figure 6:
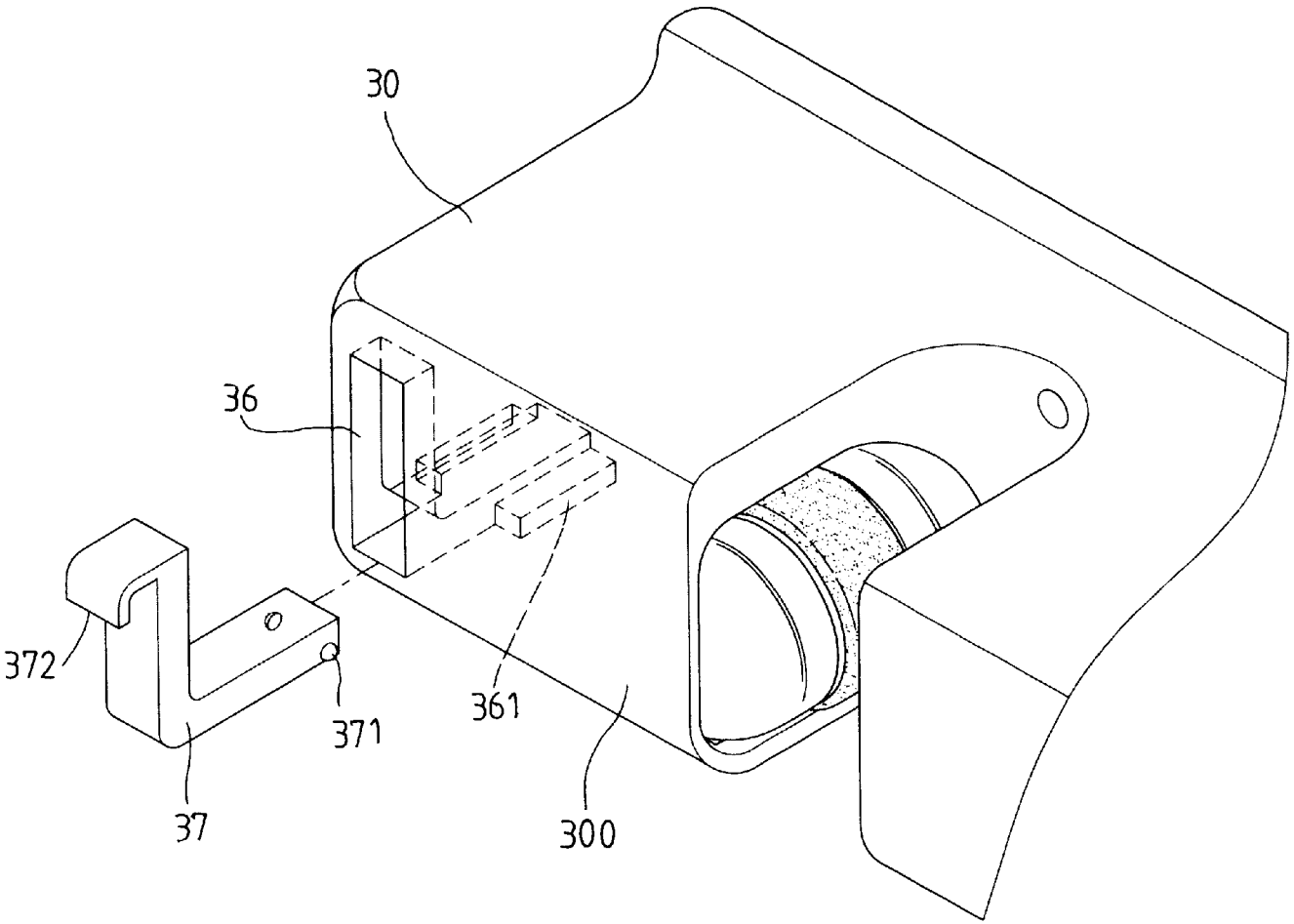
FIG. 6 is an exploded view to show the hook and the base of the clamp device of the present invention.
Figure 7:
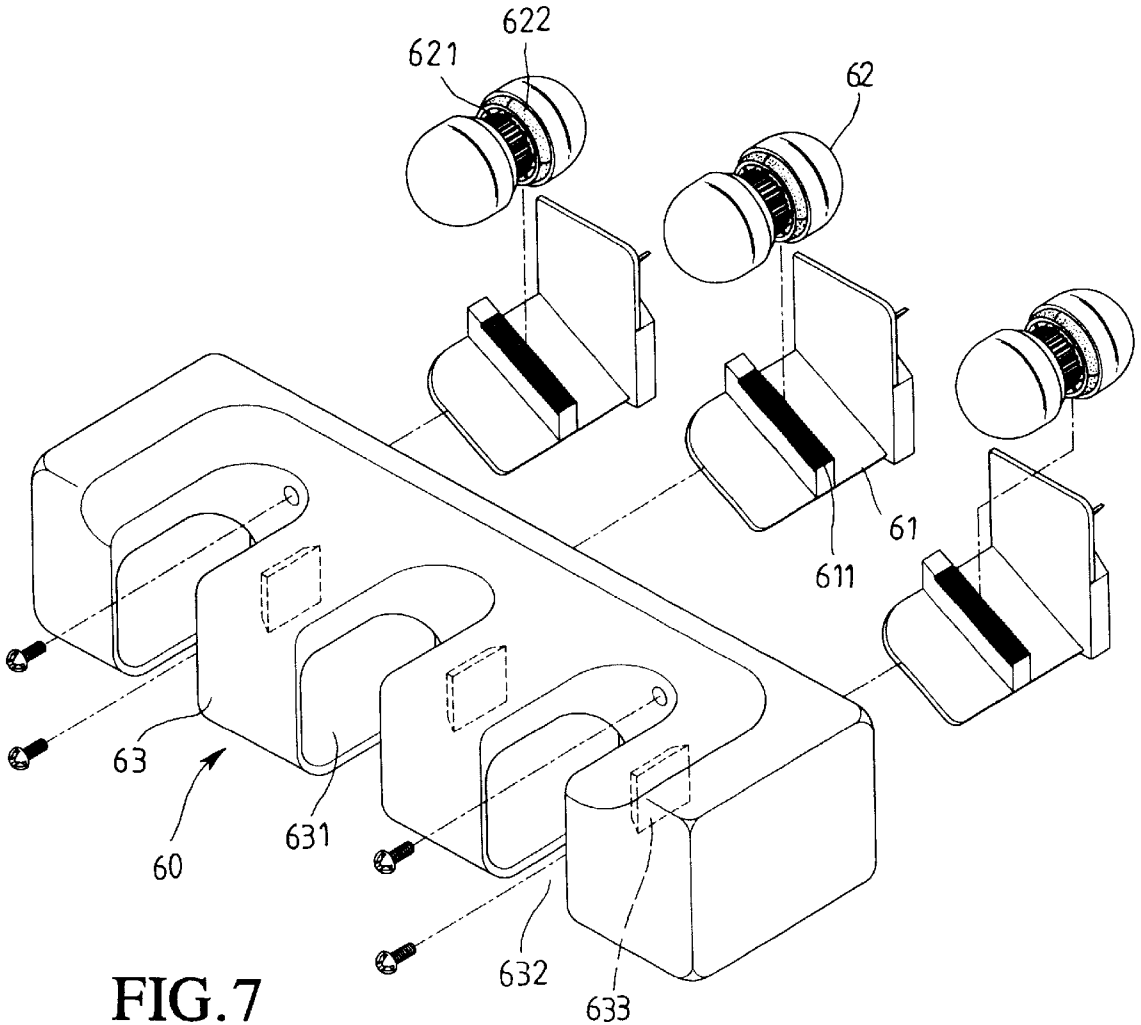
FIG. 7 PRIOR ART
FIG. 7 is an exploded view to show the conventional clamp device.
Figure 8:
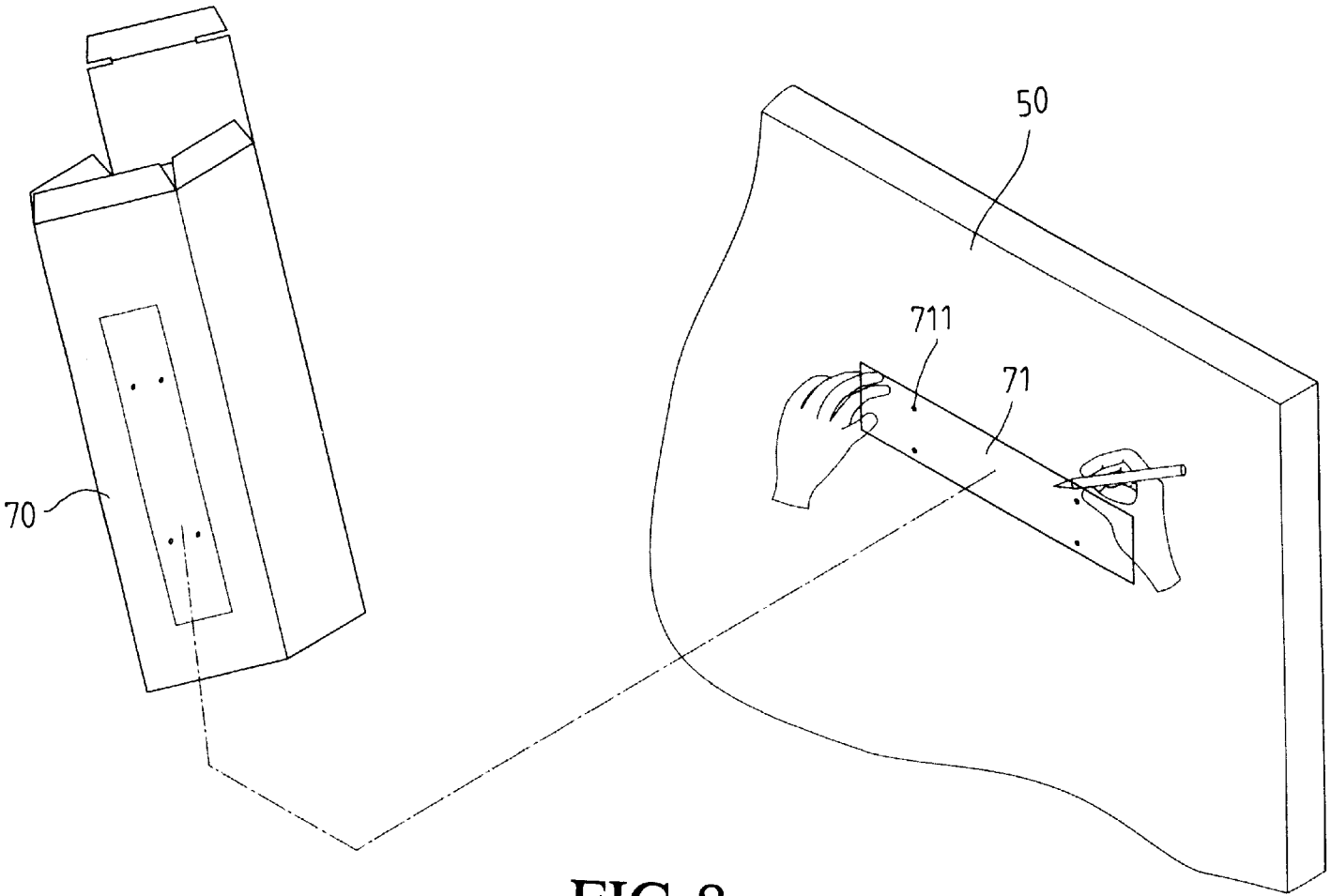
FIG. 8 PRIOR ART
FIG. 8 shows a guide board and the conventional clamp device.

Referring to FIGS. 5 and 6, an L-shaped passage 36 is defined each of the protrusions 300 and two recesses 361 communicate with the passage 36. An L-shaped hook 37 is movably engaged with the passage 36 and has two bosses 371 extending from two opposite sides of the hook 37. The two bosses 371 are movably received in the two recesses 361 so that the hook 37 will not be pulled out from the passage 36. A finger access 372 is connected to the hook 37 and accessible from outside of the base 30 so that the user may pulled the finger access 372 to pull the hook 37 out.

While we have shown and described the embodiment in accordance with the present invention, it should be clear to those skilled in the art that further embodiments may be made without departing from the scope of the present invention.

What is claimed is:

1. A clamp device comprising:

a base having at least two protrusions and a recess defined between the at least two protrusions, a chamber defined in an inside of one of the at least two protrusions and a friction pad being attached to an inside of the other of the at least two protrusions;

a frame received in the chamber and having an inclined plate, two parallel rails extending from a top surface of the inclined plate, and a roller received in the chamber and two grooves defined in an outer surface of the roller, a friction member mounted to the roller and located between the two grooves, the roller movably connected to the inclined plate by engaging the two rails with the grooves of the roller.

2. The clamp device as claimed in claim 1 further comprising a board adapted to be connected on a wall and at least one tube extending from the board, a threaded hole defined in the tube, an aperture defined through the base and located between the two protrusions, a screw extending through the aperture and threadedly engaged with the threaded hole of the tube.

3. The clamp device as claimed in claim 1 further comprising a hook retractably received in one of the at least two protrusions.

4. The clamp device as claimed in claim 3 wherein a finger access is connected to the hook and is disposed to be accessible from outside of the base.

5. The clamp device as claimed in claim 3 further comprising a passage defined in the one of the at least two protrusions and the hook movably engaged with the passage, two bosses extending from two opposite sides of the hook and two recesses communicating with the passage so that the two bosses are movably received in the two recesses.

* * * * *